US008314822B2

(12) United States Patent
Shoji et al.

(10) Patent No.: US 8,314,822 B2
(45) Date of Patent: Nov. 20, 2012

(54) THERMAL HEAD AND PRINTER

(75) Inventors: Noriyoshi Shoji, Chiba (JP); Norimitsu Sanbongi, Chiba (JP); Toshimitsu Morooka, Chiba (JP); Keitaro Koroishi, Chiba (JP)

(73) Assignee: Seiko Instruments Inc. (JP)

( * ) Notice: Subject to any disclaimer, the term of this patent is extended or adjusted under 35 U.S.C. 154(b) by 146 days.

(21) Appl. No.: 12/928,257

(22) Filed: Dec. 7, 2010

(65) Prior Publication Data

US 2011/0141216 A1 Jun. 16, 2011

(30) Foreign Application Priority Data

Dec. 15, 2009 (JP) ..... 2009-284154

(51) Int. Cl.
*B41J 2/335* (2006.01)

(52) U.S. Cl. ..... 347/208

(58) Field of Classification Search ..... 347/200, 347/206, 208

See application file for complete search history.

(56) References Cited

U.S. PATENT DOCUMENTS 4,723,130 A * 2/1988 Takanashi et al. ..... 347/206
5,142,300 A * 8/1992 Aoki ..... 347/183
6,139,130 A * 10/2000 Takahashi et al. ..... 347/62
2009/0090703 A1* 4/2009 Morooka et al. ..... 219/201
2011/0149008 A1* 6/2011 Koroishi et al. ..... 347/206

FOREIGN PATENT DOCUMENTS

JP 56-21876 * 2/1981
JP 4-319446 * 11/1992
JP 2007-93532 * 4/2007

* cited by examiner

*Primary Examiner* — Huan Tran

(74) *Attorney, Agent, or Firm* — Adams & Wilks

(57) ABSTRACT

Provided is a thermal head capable of making good contact to a thermal recording medium or the like to increase heat transfer efficiency while maintaining the number of manufacturing steps and manufacturing cost. Provided is a thermal head (1) including: a flat plate-shaped substrate main body (13); a heating resistor (15) of a substantially rectangular shape formed on a surface of the flat plate-shaped substrate main body (13); and a pair of electrodes (17A, 17B) connected to both ends of the heating resistor (15), for supplying power to the heating resistor (15), in which the pair of electrodes (17A, 17B) respectively include connecting portions (27A, 27B) having a width dimension smaller than a width dimension of the heating resistor (15), and the connecting portions (27A, 27B) are connected to the heating resistor (15) at positions shifted from each other in a width direction of the heating resistor (15).

7 Claims, 10 Drawing Sheets

THERMAL HEAD AND PRINTER

FIELD OF THE INVENTION

The present invention relates to a thermal head and a printer.

DESCRIPTION OF THE RELATED ART

There has been conventionally known a thermal head for use in thermal printers that are installed in compact information equipment terminals typified by a compact hand-held terminal, which is capable of printing on a thermal recording medium by selectively supplying a plurality of heating resistors with current and pressing the surface of an abrasion-resistant layer covering heating portions of the heating resistors against the thermal recording medium (see, for example, Japanese Patent Application Laid-open No. Hei 04-319446).

In such a thermal head, steps are defined between the heating portion of the heating resistor and each of a pair of electrodes connected to both end portions of the heating resistor. Because of the steps, a hollow is formed in the surface of the abrasion-resistant layer covering the heating portions. If there is such a hollow, the hollow forms a space when the thermal recording medium and the surface of the abrasion-resistant layer are brought into contact with each other for printing, resulting in insufficient transfer of heat from the heating portions to the thermal recording medium. For that reason, in the thermal head described in Japanese Patent Application Laid-open No. Hei 04-319446, an insulating material is embedded between the steps defined by the electrodes so that a portion between the electrodes and the surface of the abrasion-resistant layer formed thereabove have a substantially flat shape, to thereby enable the thermal recording medium to be easily brought into contact with the surface of the abrasion-resistant layer.

However, the thermal head described in Japanese Patent Application Laid-open No. Hei 04-319446 requires work for embedding the insulating material between the steps defined by the electrodes. Accordingly, there is an inconvenience that the number of manufacturing steps is increased to raise manufacturing cost.

SUMMARY OF THE INVENTION

The present invention has been made in view of the above-mentioned circumstances, and it is an object of the present invention to provide a thermal head capable of making good contact to a thermal recording medium or the like to increase heat transfer efficiency while maintaining the number of manufacturing steps and manufacturing cost, and also to provide a printer including the thermal head.

In order to achieve the above-mentioned object, the present invention provides the following measures.

The present invention provides a thermal head including: a flat plate-shaped substrate; a heating resistor of a substantially rectangular shape formed on a surface of the flat plate-shaped substrate; and a pair of electrodes connected to both ends of the heating resistor, for supplying power to the heating resistor, in which the pair of electrodes respectively include connecting portions having a width dimension smaller than a width dimension of the heating resistor, and the connecting portions are connected to the heating resistor at positions shifted from each other in a width direction of the heating resistor.

According to the present invention, the width dimension of the connecting portions is smaller than the width dimension of the heating resistor, to thereby expand an area of a bottom surface of a hollow formed between steps defined by one of the connecting portions and another thereof. Besides, the connecting portions are shifted from each other in the width direction of the heating resistor, to thereby increase a minimum distance between the electrodes or reduce a width dimension of a region which defines the minimum distance between the electrodes.

With such a structure, the heating resistor is pressed against the thermal recording medium or the like for printing, the steps defined by the connecting portions may form a smaller space between the thermal recording medium or the like and the bottom surface of the hollow to increase a contact area between the thermal recording medium or the like and the bottom surface of the hollow. Therefore, without the need for such work as to increase the number of manufacturing steps compared with a conventional thermal head, good contact to the thermal recording medium or the like may be obtained to increase the heat transfer efficiency while maintaining the manufacturing cost.

In the present invention, the connecting portions may be connected to the heating resistor at diagonal positions.

With such a structure, a region where contact to the thermal recording medium or the like is poor because of the steps defined by the connecting portions may be reduced in size in the width direction of the heating resistor. Therefore, it is possible to press, against the thermal recording medium or the like, the bottom surface of the hollow over a wide range including the other diagonal positions of the heating resistor, at which no connecting portion is connected.

Further, in the above-mentioned invention, the heating resistor may include a through-hole formed substantially in a center thereof so as to pass through the heating resistor in a thickness direction.

With such a structure, a current flowing through the heating resistor substantially linearly from the connecting portion of one of the electrodes toward the connecting portion of another of the electrodes may detour around the through-hole to prevent current density concentration on the vicinity of the center of the heating resistor. Therefore, heat may be dispersed over a wide range of the heating resistor to increase the heat transfer efficiency.

Still further, in the above-mentioned invention: the flat plate-shaped substrate may include a support substrate and an upper substrate which are bonded to each other in a stacked state; at least one of a bonding surface of the support substrate on the upper substrate side and a bonding surface of the upper substrate on the support substrate side may include a concave portion provided in a region opposed to the heating resistor; and the concave portion may form a cavity portion between the support substrate and the upper substrate.

With such a structure, the upper substrate disposed directly under the heating resistor functions as a heat storage layer that stores heat generated by the heating resistor. On the other hand, the cavity portion formed by the concave portion provided in the region opposed to the heating resistor functions as a hollow heat-insulating layer that blocks the heat transferring from the upper substrate toward the support substrate.

Therefore, because of the formation of the cavity portion, among an amount of the heat generated by the heating resistor, an amount of the heat transferring from the upper substrate toward the support substrate may be reduced to increase an amount of heat transferring from the heating resistor to an opposite side of the heating resistor with respect to the upper substrate to be utilized for printing and the like, to thereby increase the heating efficiency.

Still further, in the above-mentioned invention, each of opposed surfaces of the connecting portions that are opposed to each other may have a convex curved surface shape.

With such a structure, the steps with a small curvature are finally formed at corners of the connecting portions, and hence the thermal recording medium or the like may easily be pressed onto the bottom surface of the hollow. Therefore, the contact area between the thermal recording medium or the like and the bottom surface of the hollow may be expanded to increase the heat transfer efficiency. Besides, because the opposed surfaces of the connecting portions have rounded corners, current concentration on the corners of the connecting portions may be mitigated. Note that, in the above-mentioned invention, the convex curved surface shape may have a radius that is ⅓ or less the width dimension of the pair of electrodes.

The present invention also provides a printer including: the thermal head according to the present invention; and a pressure mechanism for feeding a thermal recording medium while pressing the thermal recording medium against the heating resistor of the thermal head.

According to the present invention, the thermal head capable of making good contact to the thermal recording medium or the like is used, and hence the heat generated by the heating resistor may be transferred with high efficiency to the thermal recording medium that is pressed against the heating resistor by the pressure mechanism. Besides, because of the thermal head having high heating efficiency, power consumption during printing on the thermal recording medium may be reduced.

The present invention provides an effect of making good contact to the thermal recording medium or the like to increase the heat transfer efficiency while maintaining the number of manufacturing steps and manufacturing cost.

DETAILED DESCRIPTION OF THE PREFERRED EMBODIMENT

Now, a thermal head and a thermal printer (printer) according to an embodiment of the present invention are described below with reference to the accompanying drawings.

Figure 1:
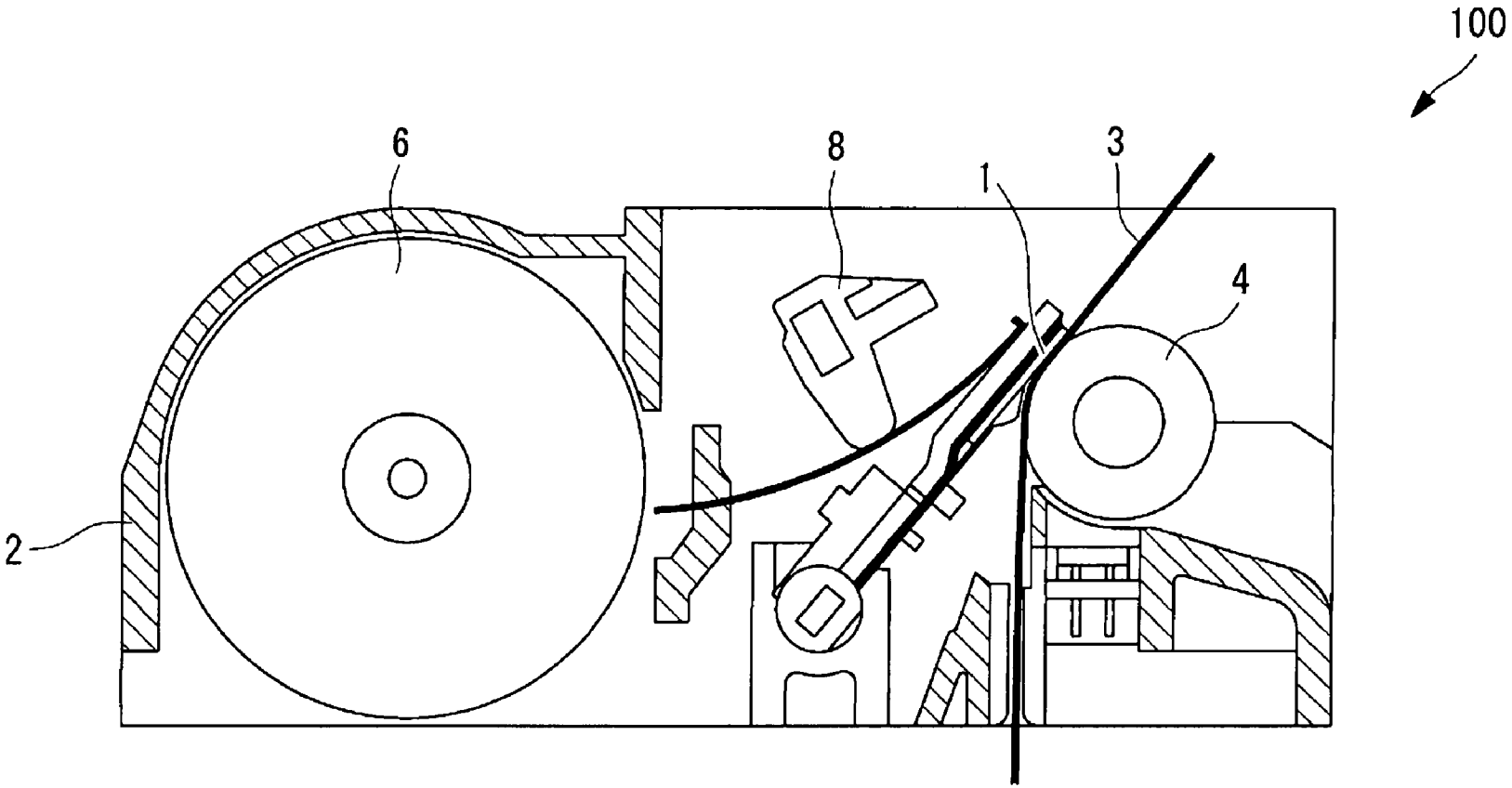
FIG. 1 is a schematic structural view of a thermal printer according to an embodiment of the present invention.

A thermal head 1 according to this embodiment is used for, for example, a thermal printer 100 as illustrated in FIG. 1. The thermal printer 100 includes a main body frame 2, a platen roller 4 disposed horizontally, the thermal head 1 disposed so as to be opposed to an outer peripheral surface of the platen roller 4, a paper feeding mechanism 6 for feeding an object to be printed, such as thermal paper (thermal recording medium) 3, between the platen roller 4 and the thermal head 1, and a pressure mechanism 8 for pressing the thermal head 1 against the thermal paper 3 with a predetermined pressing force.

Against the platen roller 4, the thermal head 1 and the thermal paper 3 are pressed by the operation of the pressure mechanism 8. Accordingly, a load of the platen roller 4 is applied to the thermal head 1 via the thermal paper 3.

Figure 2:
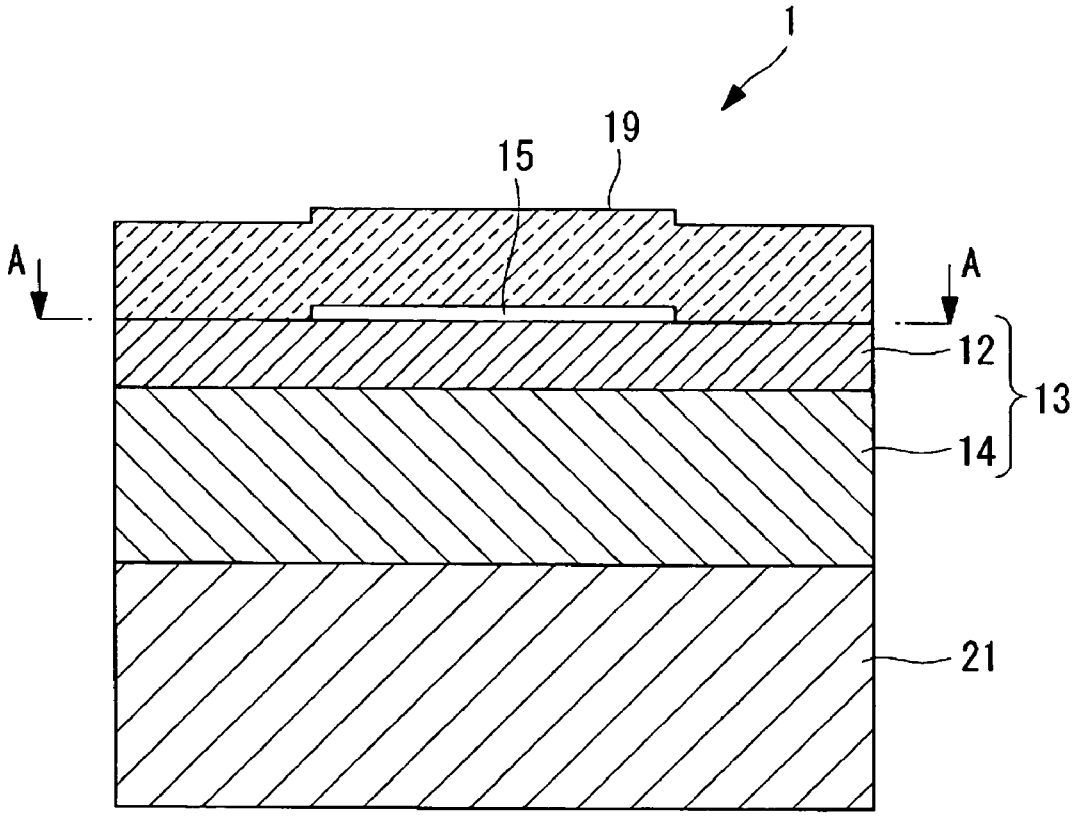
FIG. 2 is a cross-sectional view of a thermal head of FIG. 1 cut along a stacking direction.
Figure 3:
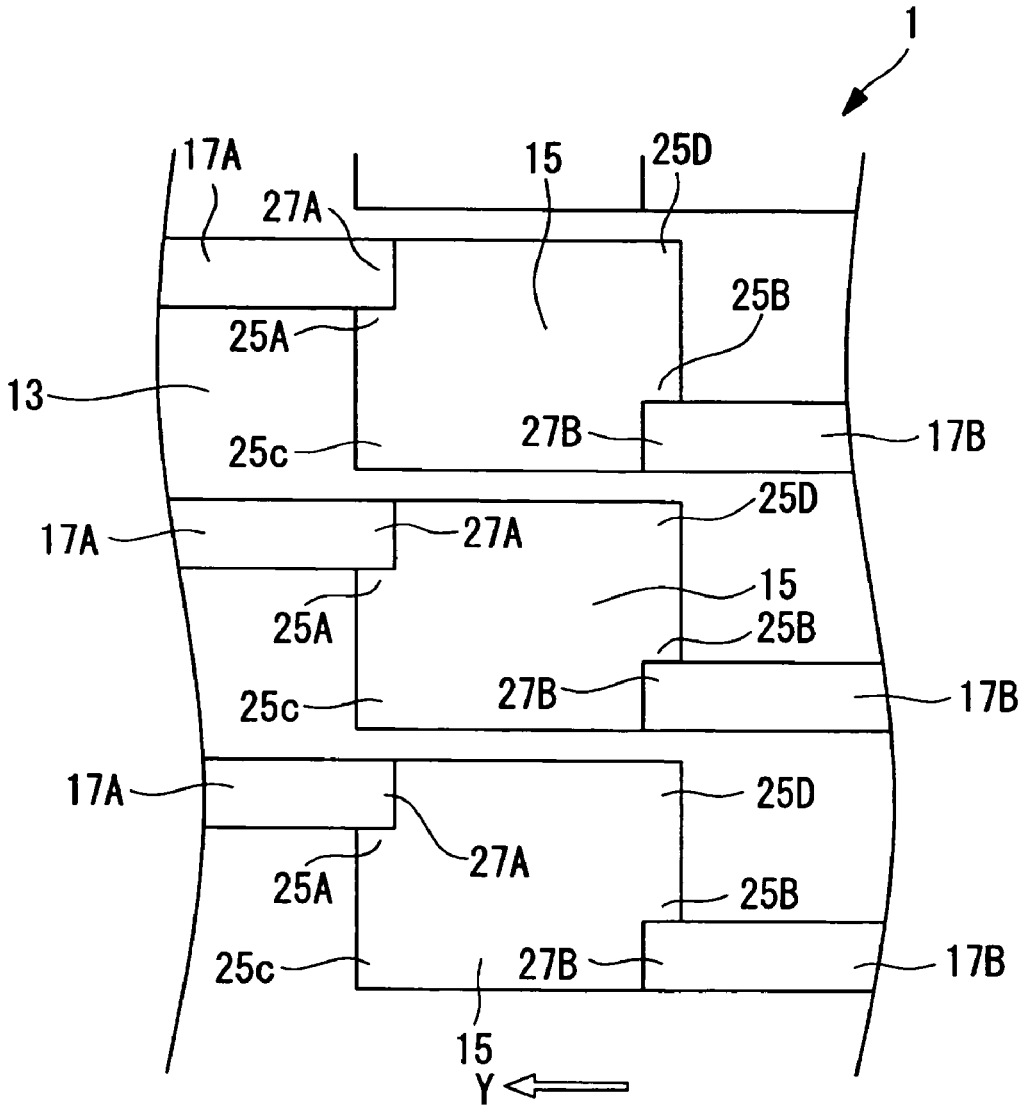
FIG. 3 is a plan view of the thermal head of FIG. 2 viewed in a direction of the arrow A.

As illustrated in FIGS. 2 and 3, the thermal head 1 includes a flat plate-shaped substrate main body (substrate) 13, a plurality of flat plate-shaped heating resistors 15 provided on the substrate main body 13, electrode portions 17A and 17B formed on the substrate main body 13 and connected to the heating resistors 15, and a protective film 19 covering the heating resistors 15 and the electrode portions 17A and 1713 on the substrate main body 13. In FIG. 3, the arrow Y represents a feeding direction of the thermal paper 3 by the platen roller 4 (the same holds true for FIGS. 5, 6, 7, 8, 9, and 11).

The substrate main body 13 is fixed to a heat dissipation plate 21 as a plate-shaped member made of a metal such as aluminum, a resin, ceramics, glass, or the like, to thereby dissipate heat via the heat dissipation plate 21. The substrate main body 13 includes a flat plate-shaped upper substrate 12 and a flat plate-shaped support substrate 14 which are bonded in a stacked state. The upper substrate 12 has the heating resistors 15 formed thereon, and the support substrate 14 supports the upper substrate 12 and is fixed to the heat dissipation plate 21.

The upper substrate 12 is a glass substrate with a thickness approximately ranging from 10 μm to 50 μm. The upper substrate 12 is disposed directly under the heating resistors 15 to function as a heat storage layer for storing a part of heat generated from the heating resistors 15.

The support substrate 14 is, for example, an insulating substrate such as a glass substrate or a ceramic substrate having a thickness approximately ranging from 300 μm to 1 mm. For the upper substrate 12 and the support substrate 14, it is desired to use glass substrates made of the same material or substrates having similar properties.

The plurality of heating resistors 15 are arrayed on a surface of the upper substrate 12 at predetermined intervals in a longitudinal direction of the substrate main body 13. Those heating resistors 15 are formed by a thin film formation method such as sputtering, chemical vapor deposition (CVD), or deposition. For example, a thin film of a heating resistor material, such as a Ta-based thin film or a silicide-based thin film, is deposited on the upper substrate 12, and the thin film is molded by lift-off, etching, or the like to form the heating resistors 15 of a desired shape, for example, a rectangular shape.

The electrode portions 17A and 17B supply the heating resistors 15 with power to allow the heating resistors 15 to generate heat. The electrode portions 17A and 17B include a common electrode 17A disposed on one end side of the heating resistors 15 in a longitudinal direction thereof, which is orthogonal to a width direction (array direction of the heating resistors 15), and a plurality of individual electrodes 17B disposed on another end side of each of the heating resistors 15. The common electrode 17A is integrally connected to all the heating resistors 15, and the individual electrodes 17B are connected to the heating resistors 15 individually.

The common electrode 17A and the individual electrode 17B have a connecting portion 27A and a connecting portion 27B connected to the heating resistor 15, respectively. Those connecting portions 27A and 27B have a width dimension smaller than a width dimension of the heating resistor 15, for example, a width that is approximately ½ to ¼ a width of the heating resistor 15.

The connecting portion 27A and the connecting portion 27B are connected to the heating resistor 15 at positions shifted from each other in the width direction thereof. Specifically, the connecting portion 27A is connected to the heating resistor 15 so as to cover a corner 25A at one end thereof, while the connecting portion 27B is connected to the heating resistor 15 so as to cover a corner 25B at a diagonal position of the corner 25A.

Those electrode portions 17A and 17B are formed as follows. A film of a wiring material such as Al, Al—Si, Au, Ag, Cu, or Pt is deposited on the upper substrate 12 by sputtering, vapor deposition, or the like. Then, the film thus obtained is molded by lift-off or etching, or alternatively the wiring material is baked after screen printing, to thereby form the electrode portions 17A and 17B of desired shapes.

The protective film 19 protects the heating resistors 15 and the electrode portions 17A and 17B from abrasion and corrosion. The protective film 19 is formed, for example, as follows. After the heating resistors 15 and the electrode portions 17A and 17B are formed on the substrate main body 13, a film of a protective film material such as $SiO_2$, $Ta_2O_5$, SiAlON, $Si_3N_4$, or diamond-like carbon is deposited on the upper substrate 12 by sputtering or the like.

Here, when sputtering is used to form the protective film 19, a hollow is formed by steps defined by the connecting portions 27A and 27B in a surface of the protective film 19, which is formed above the heating resistors 15.

According to the thermal head 1 of this embodiment, the width dimension of the connecting portions 27A and 27B is smaller than the width dimension of the heating resistors 15, to thereby reduce an area of the protective film 19 in which the surface shape is convex because of being situated above the connecting portion 27A or 27B, while increasing an area of the protective film 19 in which the surface shape is hollow because of being situated above and between the steps defined by the connecting portions 27A and 27B (that is, an area of the bottom surface of the hollow).

Further, the connecting portions 27A and 27B are connected to the heating resistor 15 at the diagonal positions, to thereby increase a minimum distance between the steps defined by the connecting portions 27A and 27B on the bottom surface of the hollow formed in the surface of the protective film 19. The bottom surface of the hollow corresponds to a heating region, which is brought into contact with the thermal paper 3 to perform efficient printing.

Note that, the thermal head 1 structured in this way may be manufactured in the same number of manufacturing steps as a conventional thermal head.

Hereinafter, an action of the thermal head 1 and the thermal printer 100 according to this embodiment is described.

In printing on the thermal paper 3 using the thermal printer 100 according to this embodiment, first, a voltage is selectively applied to the individual electrodes 17B. Then, a current flows through the heating resistors 15 which are connected to the selected individual electrodes 17B and the common electrode 17A opposed thereto, to thereby allow the heating resistors 15 to generate heat.

Subsequently, the pressure mechanism 8 operates to press the thermal head 1 against the thermal paper 3 being fed by the platen roller 4. The platen roller 4 rotates about an axis parallel to the array direction of the heating resistors 15, to thereby feed the thermal paper 3 toward the Y direction orthogonal to the array direction of the heating resistors 15. Against the thermal paper 3, a surface portion (printing portion) of the protective film 19 covering the heating resistors 15 is pressed, and then color is developed on the thermal paper 3 to be printed.

In this case, the area of the bottom surface of the hollow formed in the surface of the protective film 19 situated above the heating resistor 15 is large, and the minimum distance between the steps defined by the connecting portions 27A and 27B on the bottom surface of the hollow is also large. Therefore, the steps have a small influence on the surface of the protective film 19, which enables good contact of the bottom surface of the hollow to the thermal paper 3.

Figure 4:
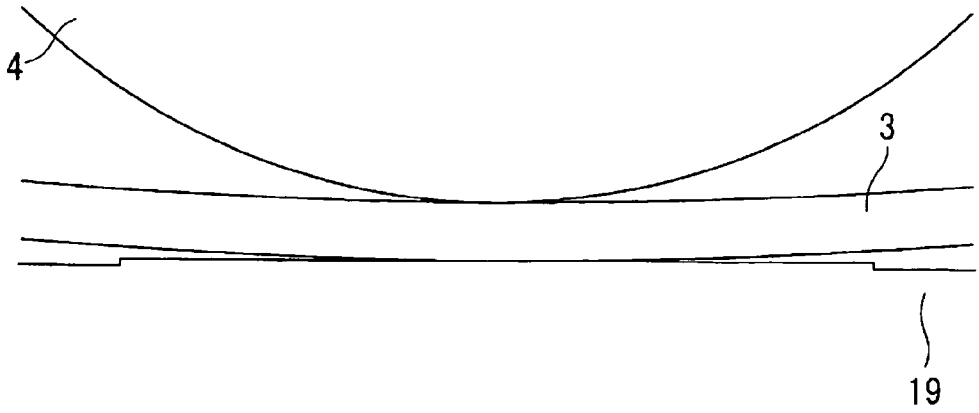
FIG. 4 is a vertical cross-sectional view illustrating a contact state between the thermal head of FIG. 2 and thermal paper.

Specifically, as illustrated in FIG. 4, from above another corner 25D toward above still another corner 25*c* of the heating resistors 15, the thermal paper 3 and the surface of the protective film 19 may be brought into contact with each other, with no space formed therebetween due to the steps defined by the connecting portions 27A and 27B. Therefore, the heat generated by the heating resistor 15 may be transferred efficiently to the thermal paper 3.

Therefore, according to the thermal head 1 and the thermal printer 100 of this embodiment, the heat transfer efficiency may be increased while maintaining the same number of manufacturing steps and manufacturing cost as those of the conventional one. Besides, because the connecting portions 27A and 27B of the electrode portions 17A and 17B have a small width dimension, loss of heat that dissipates from the connecting portions 27A and 27B may be reduced. Further, because of the small influence of the steps defined by the connecting portions 27A and 27B, bits of paper and the like, which are generated when the thermal paper 3 and the thermal head 1 are brought into rubbing contact with each other, are less likely to remain in the hollow of the surface of the protective film 19, and hence a printing failure may be prevented.

Note that, the embodiment of the present invention may be modified as follows.

Figure 5:
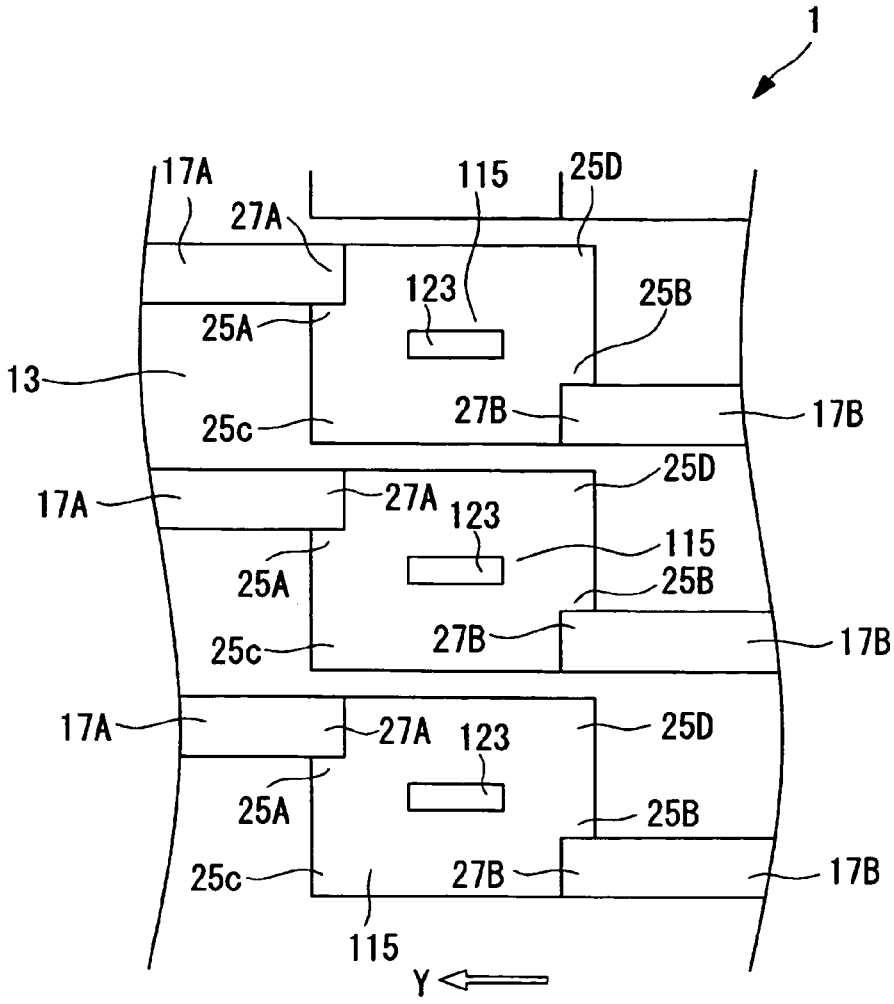
FIG. 5 is a plan view of a thermal head viewed from a protective film side according to a modified example of the embodiment of the present invention.
Figure 6:
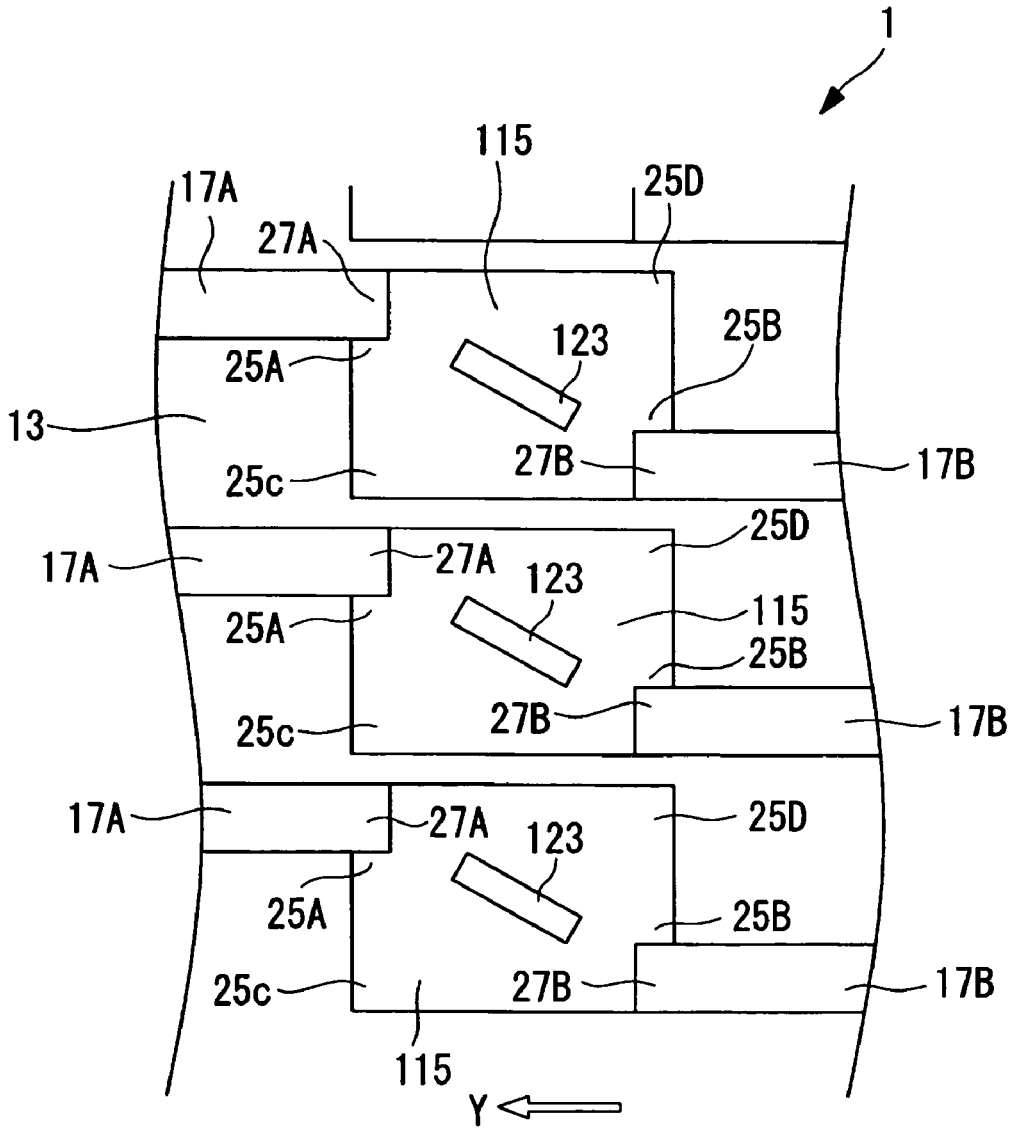
FIG. 6 is a plan view of a thermal head viewed from the protective film side according to another modified example of the embodiment of the present invention.

For example, as illustrated in FIGS. 5 and 6, a slit (through-hole) 123 may be formed substantially in the center of a heating resistor 115 so as to pass through the heating resistor 115 in a thickness direction thereof. With such a structure, a current flowing through the heating resistor 115 substantially linearly from the connecting portion 27B of the individual electrode 17B toward the connecting portion 27A of the common electrode 17A may detour around the slit 123 to prevent current density concentration on the vicinity of the center of the heating resistor 115.

Therefore, heat may be dispersed over a wide range of the heating resistor 115 to increase heat transfer efficiency. Note that, as illustrated in FIG. 5, the slit 123 may have a shape extending along the longitudinal direction of the heating resistor 115, or alternatively as illustrated in FIG. 6, the slit 123 may have a shape extending along a direction in which the connecting portion 27A and the connecting portion 27B are opposed to each other. Further, an example of the through-hole is a hole which is circular in cross-section having a predetermined radius dimension.

In the embodiment of the present invention, the description has been given of the substrate main body 13 by way of example, which is simply formed of the flat plate-shaped upper substrate 12 and the flat plate-shaped support substrate 14. As an alternative thereto, for example, a concave portion recessed in a thickness direction may be formed in at least one of a bonding surface of the upper substrate 12 on the support substrate side and a bonding surface of the support substrate 14 on the upper substrate side so that the substrate main body 13 includes a cavity portion due to the concave portion between the upper substrate 12 and the support substrate 14. Note that, the concave portion is desired to be formed in a region opposed to the heating resistors 15.

With such a structure, the cavity portion formed in the region opposed to the heating resistors 15 may function as a hollow heat-insulating layer that blocks the heat transferring from the upper substrate 12 toward the support substrate 14. Therefore, because of the formation of the cavity portion, among an amount of the heat generated by the heating resistors 15, an amount of the heat transferring from the upper substrate 12 toward the support substrate 14 may be reduced to increase an amount of heat transferring from the heating resistors 15 toward the protective film 19 to be utilized for printing and the like, to thereby increase heating efficiency.

Figure 7:
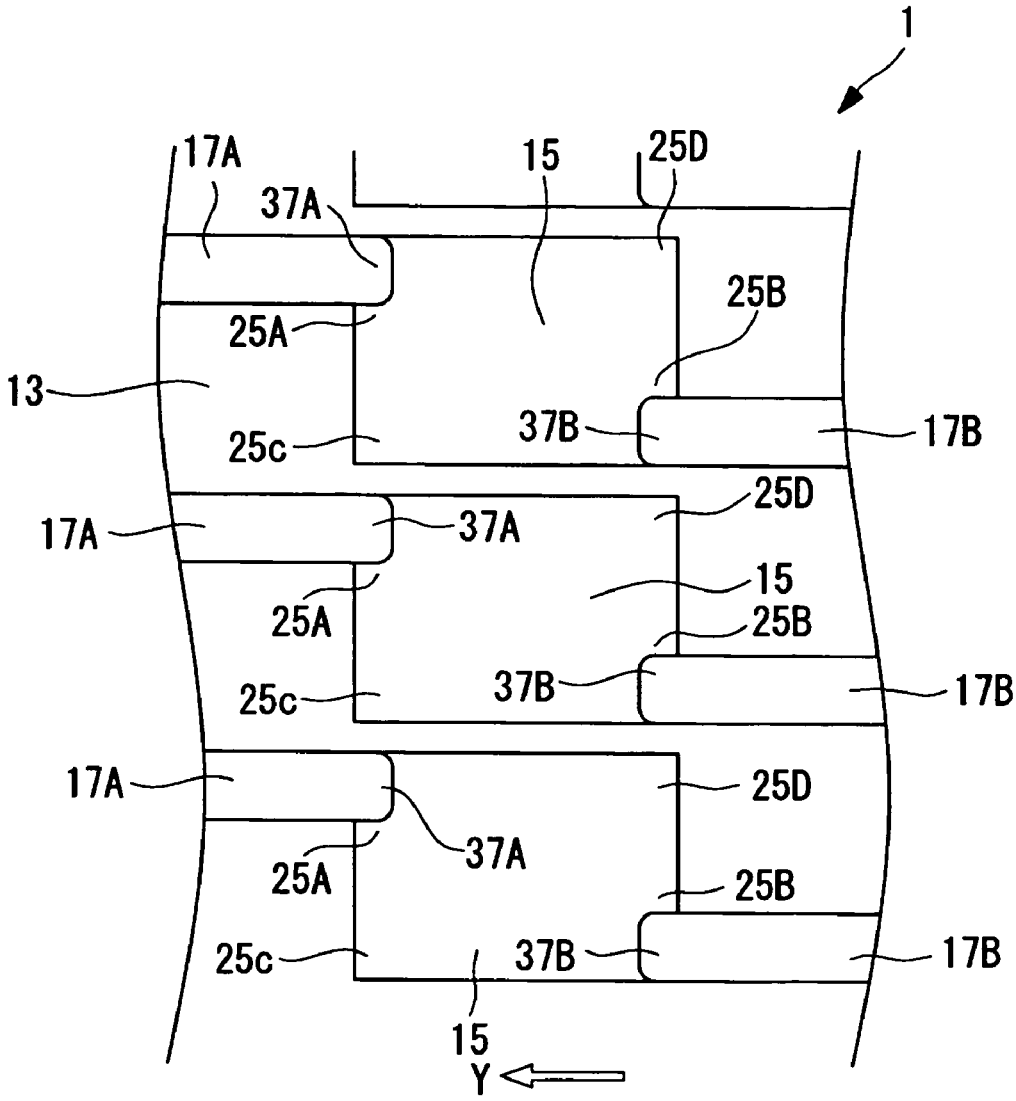
FIG. 7 is a plan view of a thermal head viewed from the protective film side according to a further modified example of the embodiment of the present invention.

Further, in the embodiment of the present invention, the description has been given, referring to the drawings, of the connecting portions 27A and 27B of the electrode portions 17A and 17B, each of which has a distal end formed at substantially a right angle. As an alternative thereto, for example, as illustrated in FIG. 7, opposed surfaces of connecting portions 37A and 37B that are opposed to each other may have a smooth convex curved surface shape with rounded corners. In this case, the corner at a distal end of the connecting portions 37A and 37B is desired to have a curved surface shape with a radius that is ⅓ or less the width dimension of the electrode portions 17A and 17B, that is, a round shape. With such a structure, the steps with a small curvature are finally formed in the protective film 19 at the distal ends of the connecting portions 37A and 37B, and hence the thermal paper 3 may easily be pressed onto the bottom surface of the hollow formed in the surface of the protective film 19. Therefore, a contact area between the thermal paper 3 and the bottom surface of the hollow may be expanded to increase the heat transfer efficiency. Besides, compared with the case of forming the right-angled corners at the distal ends of the connecting portions 27A and 27B, current concentration on the corners at the distal ends of the connecting portions 37A and 37B may be mitigated.

Figure 8:
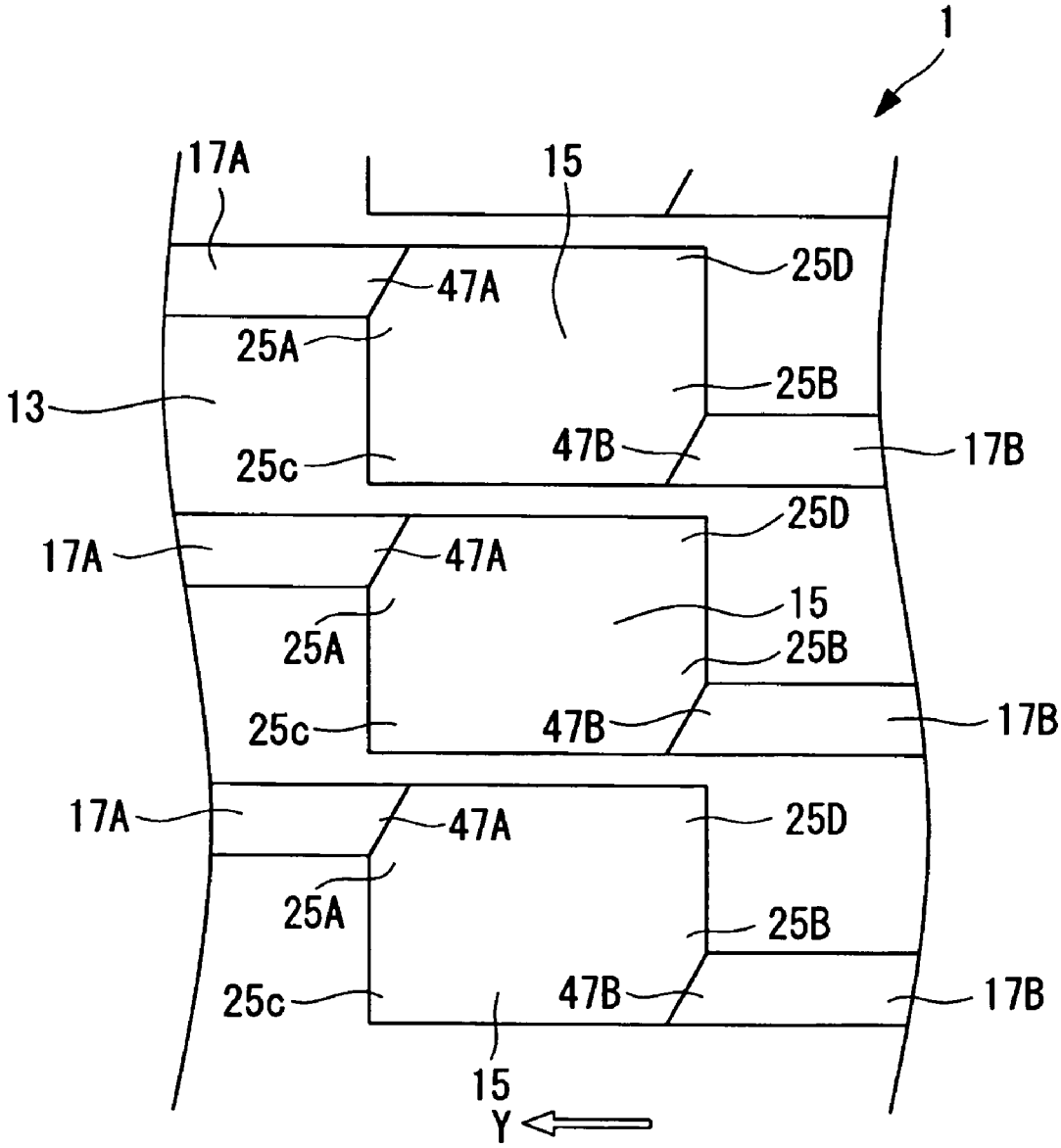
FIG. 8 is a plan view of a thermal head viewed from the protective film side according to a still further modified example of the embodiment of the present invention.

Still further, for example, as illustrated in FIG. 8, distal ends of connecting portions 47A and 47B may each have a distal end surface inclined with respect to the width direction of the electrode portions 17A and 17B so that the distal end surfaces are arranged to face each other. In this case, the distal end surfaces of the connecting portions 47A and 47B may be arranged substantially in parallel to each other. Such a structure can provide the same effect as in the case of the round corners of the connecting portions 37A and 37B, and it is possible to increase a minimum distance between steps defined by the connecting portions 47A and 47B on the bottom surface of the hollow, to thereby further expand the contact area between the thermal paper 3 and the bottom surface of the hollow. Thus, the heat transfer efficiency may be increased.

Figure 9:
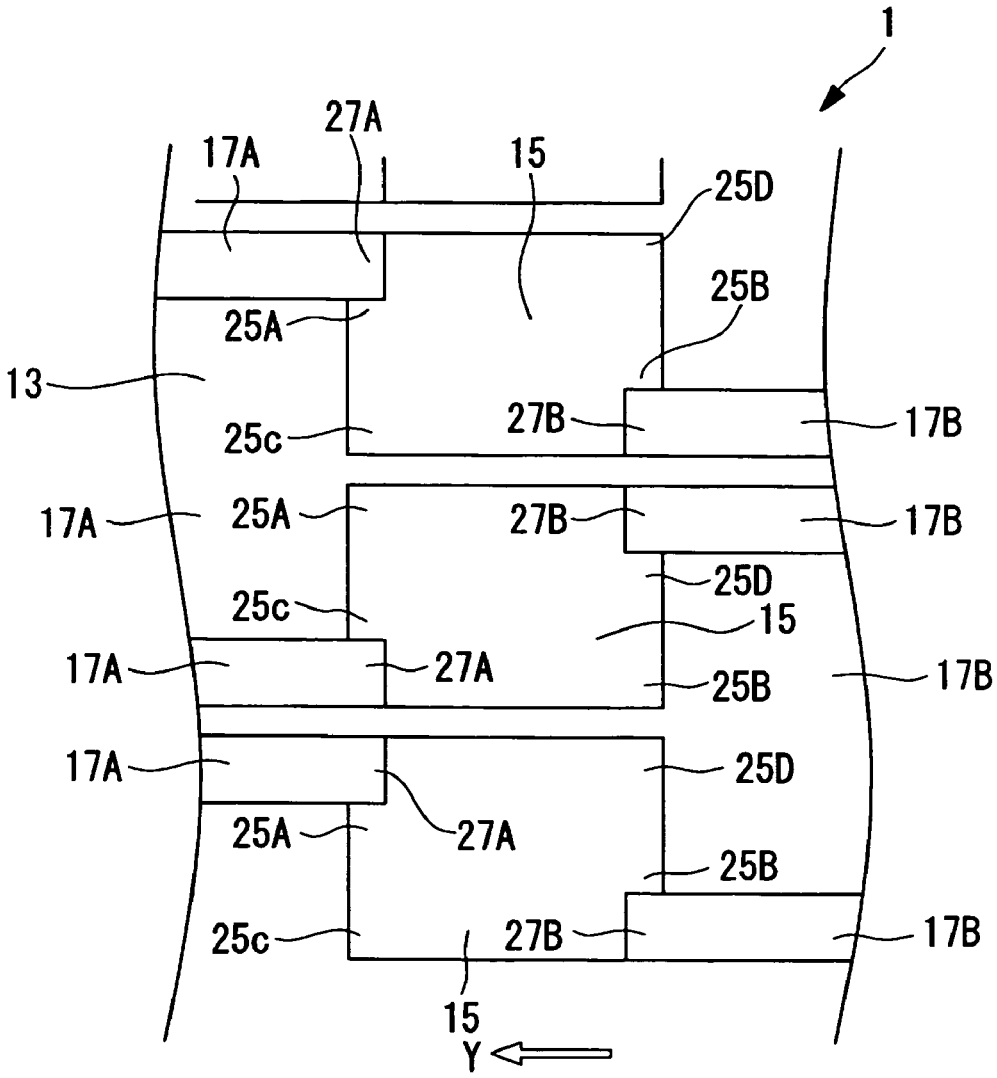
FIG. 9 is a plan view of a thermal head viewed from the protective film side according to a yet further modified example of the embodiment of the present invention.

Still further, in the embodiment of the present invention, the description has been given of the connecting portions 27A and 27B of the electrode portions 17A and 17B, which are connected to the corners 25A and 25B of each of the heating resistors 15, respectively. Alternatively, for example, such a structure as illustrated in FIG. 9 may be employed, in which one of adjacent heating resistors 15 has the connecting portions 17A and 17B respectively connected to the corners 25A and 25B, whereas another thereof has the connecting portions 27A and 27B respectively connected to the corners 25*c* and 25D. With such a structure, it is possible to increase a distance interval between the electrode portions 17A or the electrode portions 17B which are connected to the adjacent heating resistors 15. Therefore, the thermal paper 3 and the bottom surface of the hollow in the surface of the protective film 19 are easily brought into contact with each other to increase the heat transfer efficiency. In this case, the corners at the distal ends of the connecting portions 27A and 27B may have a round shape, or alternatively the distal end surfaces of the connecting portions 27A and 27B may be inclined with respect to the width direction of the electrode portions 17A and 17B so that the distal end surfaces are arranged to face each other.

Still further, in the embodiment of the present invention, the description has been given, referring to the drawings, of the electrode portions 17A and 17B, each of which has a constant width dimension. Alternatively, for example, the electrode portions 17A and 17B may have a shape in which a part other than the connecting portions 27A and 27B has a large width dimension while only the connecting portions 27A and 27B has a small width dimension.

Still further, in the embodiment of the present invention, the description has been given of the connecting portions 27A and 27B of the electrode portions 17A and 17B by way of example, which are connected to the heating resistor 15 at the diagonal positions shifted from each other. Alternatively, for example, the following structure may be employed. That is, the connecting portions 27A and 27B are connected to the heating resistor 15 to be shifted from each other in a range in which the connecting portions 27A and 27B are partially opposed to each other in the longitudinal direction of the heating resistor 15. In this case, a region which defines the minimum distance between the connecting portions 27A and 27B may be reduced in width dimension.

Figure 10:
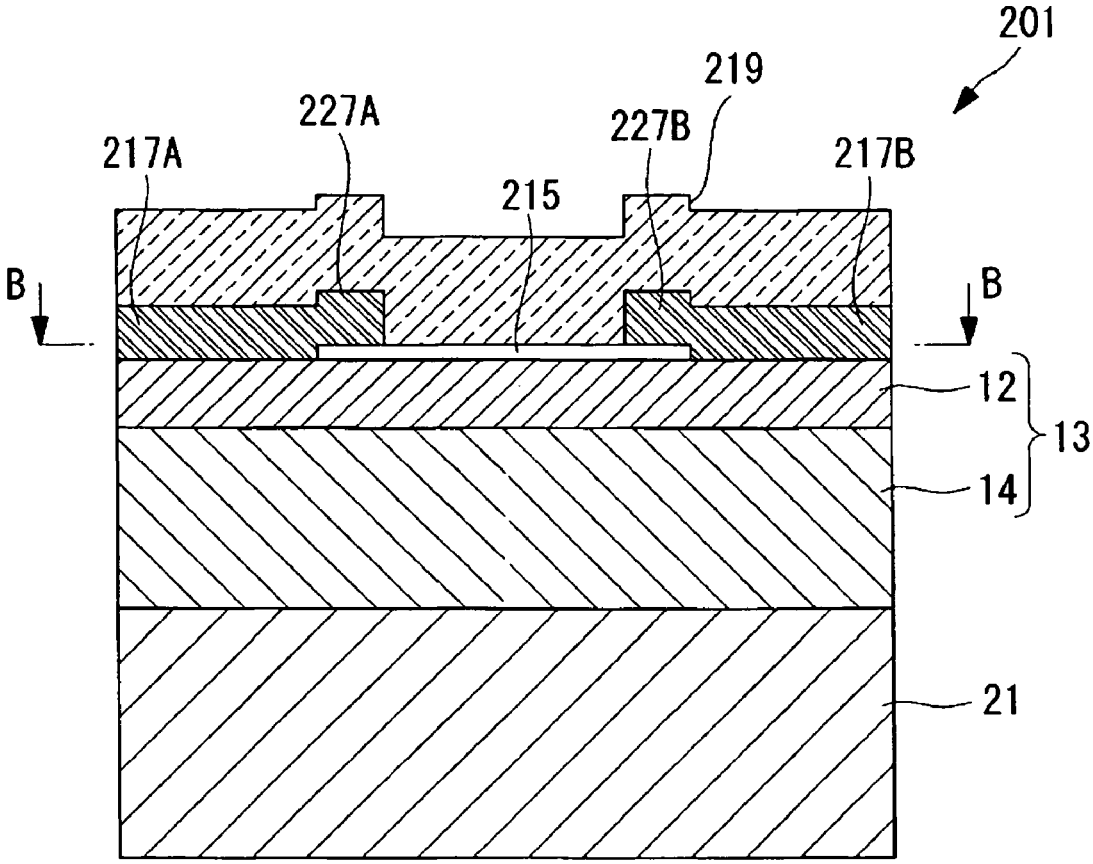
FIG. 10 PRIOR ART
FIG. 10 is a cross-sectional view of a conventional thermal head cut along a stacking direction, as a comparative example of the thermal head and the thermal printer according to the embodiment of the present invention.
Figure 11:
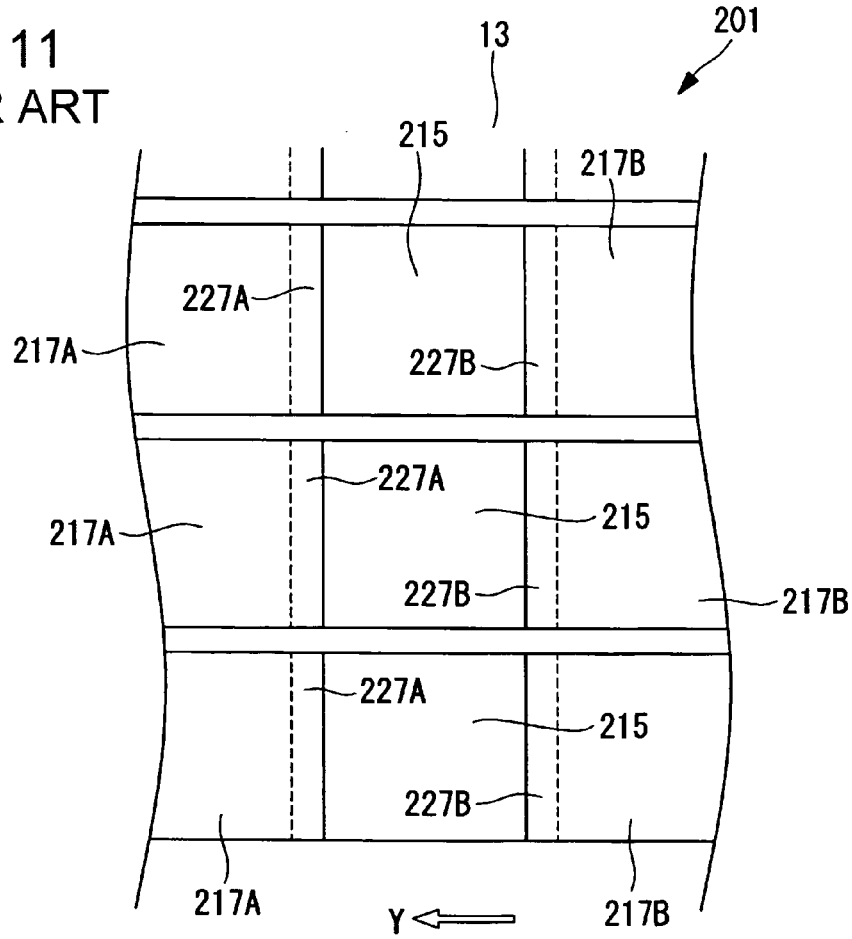
FIG. 11 PRIOR ART
FIG. 11 is a plan view of the conventional thermal head of FIG. 10 viewed in a direction of the arrow B.

Now, as a comparative example of the thermal head 1 and the printer 100 according to the embodiment of the present invention, a conventional thermal head 201 as illustrated in FIGS. 10 and 11 is described below, which includes electrode portions 217A and 217B in which connecting portions 227A and 227B have substantially the same width dimension as a width dimension of a heating resistor 215 and are connected to both ends of the heating resistor 215 in an entire range in the width direction thereof.

In the conventional thermal head 201 according to the comparative example, steps are defined by the connecting portions 227A and 227B at the both ends of the heating resistor 215 in the entire range in the width direction thereof. Because of the steps defined by the connecting portions 227A and 227B, in a surface of a protective film 219 formed by sputtering, a hollow is formed above the heating resistor 215.

Figure 12:
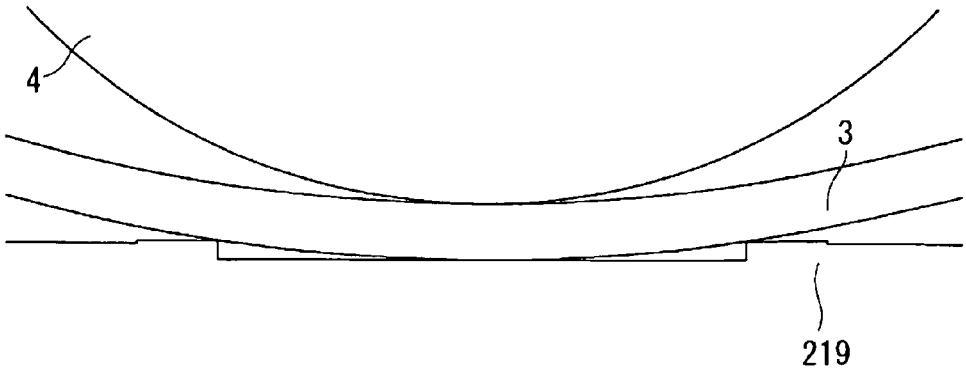
FIG. 12 PRIOR ART
FIG. 12 is a vertical cross-sectional view illustrating a contact state between the conventional thermal head of FIG. 10 and thermal paper.

If the conventional thermal head 201 according to the comparative example is used, as illustrated in FIG. 12, when the thermal head 201 is pressed against the thermal paper 3 being fed by the platen roller 4 in the Y direction, and when the thermal paper 3 is brought into contact with the surface of the protective film 219, a space is formed in the vicinity of the steps in the hollow of the surface of the protective film 219, resulting in poor contact to the thermal paper 3. Therefore, heat generated by the heating resistor 215 cannot be transferred efficiently to the thermal paper 3, with the result that the heat transfer efficiency is reduced.

What is claimed is:

1. A thermal head, comprising:

a flat plate-shaped substrate;

a heating resistor of a substantially rectangular shape formed on a surface of the flat plate-shaped substrate; and a pair of electrodes connected to both ends of the heating resistor, for supplying power to the heating resistor, wherein the pair of electrodes respectively include connecting portions having a width dimension smaller than a width dimension of the heating resistor, and the connecting portions are connected to the heating resistor at positions shifted from each other in a width direction of the heating resistor.

2. A thermal head according to claim 1, wherein the connecting portions are connected to the heating resistor at diagonal positions.

3. A thermal head according to claim 1, wherein the heating resistor includes a through-hole formed substantially in a center thereof so as to pass through the heating resistor in a thickness direction.

4. A thermal head according to claim 1, wherein the flat plate-shaped substrate includes a support substrate and an upper substrate which are bonded to each other in a stacked state, wherein at least one of a bonding surface of the support substrate on the upper substrate side and a bonding surface of the upper substrate on the support substrate side includes a concave portion provided in a region opposed to the heating resistor, and wherein the concave portion forms a cavity portion between the support substrate and the upper substrate.

5. A thermal head according to claim 1, wherein each of opposed surfaces of the connecting portions that are opposed to each other has a convex curved surface shape.

6. A thermal head according to claim 5, wherein the convex curved surface shape has a radius that is ⅓ or less the width dimension of the pair of electrodes.

7. A printer, comprising:

the thermal head according to claim 1; and a pressure mechanism for feeding a thermal recording medium while pressing the thermal recording medium against the heating resistor of the thermal head.

* * * * *